US008414109B2

(12) United States Patent
Saito

(10) Patent No.: US 8,414,109 B2
(45) Date of Patent: Apr. 9, 2013

(54) HEAD ARRAY UNIT, IMAGE FORMING APPARATUS AND HEAD REPLACING METHOD

(75) Inventor: Akira Saito, Miyagi (JP)

(73) Assignee: Ricoh Company, Ltd., Tokyo (JP)

( * ) Notice: Subject to any disclaimer, the term of this patent is extended or adjusted under 35 U.S.C. 154(b) by 218 days.

(21) Appl. No.: 13/038,617

(22) Filed: Mar. 2, 2011

(65) Prior Publication Data

US 2011/0216128 A1 Sep. 8, 2011

(30) Foreign Application Priority Data

Mar. 5, 2010 (JP) ..... 2010-049820

(51) Int. Cl.
*B41J 2/14* (2006.01)
*B41J 2/16* (2006.01)

(52) U.S. Cl. ..... 347/49; 347/40; 347/67; 347/71

(58) Field of Classification Search ..... 347/20, 347/40, 42, 43, 49, 67, 84–86
See application file for complete search history.

(56) References Cited

U.S. PATENT DOCUMENTS

| | | | | |
|---|---|---|---|---|
| 7,077,501 | B2 * | 7/2006 | Kitahara et al. | 347/40 |
| 7,431,428 | B2 * | 10/2008 | Yamada | 347/49 |
| 2006/0214986 | A1 | 9/2006 | Yagi et al. | |
| 2007/0291084 | A1 | 12/2007 | Hayashi | |
| 2009/0174750 | A1 | 7/2009 | Saito | |
| 2009/0179928 | A1 | 7/2009 | Nemoto et al. | |
| 2009/0225130 | A1 | 9/2009 | Saito | |

FOREIGN PATENT DOCUMENTS

| | | |
|---|---|---|
| JP | 2006-264181 | 10/2006 |
| JP | 2008-1085 | 1/2008 |
| JP | 2008-179081 | 8/2008 |

* cited by examiner

*Primary Examiner* — Thinh Nguyen
(74) *Attorney, Agent, or Firm* — Cooper & Dunham LLP

(57) ABSTRACT

A head array unit includes plural heads that discharge liquid droplets; a head supporting member on which the plural heads are disposed; and intermediate members, fixed to the head supporting member, having positioning reference parts configured to position the heads, wherein the heads are mounted on the intermediate members detachably from an opposite side of the intermediate members with respect to the head supporting member.

6 Claims, 10 Drawing Sheets

HEAD ARRAY UNIT, IMAGE FORMING APPARATUS AND HEAD REPLACING METHOD

BACKGROUND OF THE INVENTION

1. Field of the Invention

The present invention relates to a head array unit, an image forming apparatus and a head replacing method.

2. Description of the Related Art

As a printer, a facsimile apparatus, a copier, a plotter or a multifunction peripheral (MFP) that has functions as a printer, a facsimile, a copier and/or a plotter, for example, an image forming apparatus in a liquid discharging recording type (ink-jet recording apparatus) which uses a recording head that discharges ink droplets is known. The image forming apparatus in the liquid discharging recording type is such that ink droplets are discharged by a recording head to paper that is conveyed and forming an image is carried out. "Paper" is not particularly limited to paper, includes an OHP (i.e., overhead projector) film (i.e., a transparency film which may be suitably used in an overhead projector) or such, means one to which ink droplets or other liquid droplets can adhere, and may also be referred to as a to-be-recorded medium or a recording medium, recording paper, or such. The forming an image has the same meaning as recording, printing or such, hereinafter. The image forming apparatus in the liquid discharging recording type includes a serial-type image forming apparatus and a line-type image forming apparatus. The serial-type image forming apparatus is such that a recording head discharges liquid droplets while moving in a main scan direction and forms an image. The line-type image forming apparatus is such that a line-type head that discharges liquid droplets in a condition of not moving and forms an image is used.

Further, hereinafter, an image forming apparatus in a liquid discharging recording type means an apparatus that discharges liquid to a medium such as paper, thread, fibers, textile, leather, metal, plastic, glass, wood, ceramics or such, and carries out forming an image. Further, "forming an image" means not only giving an image having a meaning, such as letters, figures or such, to the medium, but also giving an image having no meaning, such as patterns, to the medium (i.e., merely landing liquid droplets on the medium). Further, "liquid" to be discharged is not limited to ink, is not particularly limited as long as it becomes liquid when it is discharged, and, for example, may include a DNA sample, resist, pattern material or such. Further, "image" is not limited to a two-dimensional image, but may also include an image that is given to a three-dimensionally formed medium or a figure obtained as a result of a solid body itself being three-dimensionally shaped.

As a full-line head used in the line-type image forming apparatus, which head has a length of a nozzle row corresponding to a width of a recording medium such as paper or a long-size head having a length of a nozzle row corresponding to a half of the width of the recording medium (hereinafter both heads may be generally referred to as a "long-size head"), a configuration (referred to as a head array unit) is known in which plural short-size heads are arranged (to form an array) along a direction of the width of the recording medium.

In a case where plural heads are mounted on a head supporting member and the head array unit is formed, it may be difficult for a user to replace the heads if the heads are fixed directly to the head supporting member.

In this regard, a configuration is known in which heads and spacer members are put and fixed together, and the spacer members are fixed to a head supporting member (base member) detachably (see Japanese Laid-Open Patent Applications Nos. 2006-264181 and 2008-179081).

In the above-mentioned configuration in which the heads (head units) and the spacer members are put and fixed together and the spacer members are fixed to the head supporting member (base member) detachably, convenience is improved in replacement work (removing and loading work). However, when the heads are replaced with other heads, it is necessary to newly position the spacer members with respect to the head supporting member. Therefore, when including the positioning work, convenience in head replacement work may not be so improved.

Further, in a case where positioning parts are formed directly on a head supporting member, all of the positions of many heads arranged are to be positioned with high accuracy, and therefore, materials and a processing method for processing the head supporting member are limited, and thus, the head supporting member may become very expensive.

SUMMARY OF THE INVENTION

According to an embodiment of the present invention, a head array unit includes plural heads that discharge liquid droplets; a head supporting member in which the plural heads are positioned and fixed; and intermediate members, fixed to the head supporting member, having positioning reference parts configured to position the heads, wherein the heads are mounted on the intermediate members detachably from an opposite side of the intermediate members with respect to the head supporting member.

According to another embodiment of the present invention, a method for replacing the heads of the head array unit with other heads, in which head array unit in a condition in which the heads are fixed to the intermediate members, the heads are positioned to predetermined positions and the intermediate members are fixed to the head supporting member, includes leaving the intermediate members on the head supporting member and removing the heads from the intermediate members; and fixing the other heads to the intermediate members.

Other objects, features and advantages of the present invention will become more apparent from the following detailed description when read in conjunction with the accompanying drawings.

DETAILED DESCRIPTION OF THE EMBODIMENTS

An embodiment of the present invention has been devised for the purpose of solving the above-mentioned problems, and an object of the embodiment is to provide a head array unit at low cost for which it is possible to easily maintain head position accuracy and easily replace heads.

In a head array unit according to an embodiment of the present invention, intermediate members having positioning reference parts for heads are fixed to a head supporting member, and the heads are detachably mounted on the intermediate members from an opposite side of the intermediate members with respect to the head supporting member. Thereby, it is possible to easily replace the heads with the head position accuracy being maintained.

Further, according to an embodiment of the present invention, in an image forming apparatus that includes the head array unit according to the embodiment, it is possible to easily replace the heads with the head position accuracy being maintained.

Further, according to an embodiment of the present invention, a method for replacing the heads of the head array unit according to the embodiment with other heads, in which head array unit in a condition in which the heads are fixed to the intermediate members, the heads are positioned at predetermined positions and the intermediate members are fixed to the head supporting member, includes leaving the intermediate members on the head supporting member and removing the heads from the intermediate members; and fixing the other heads to the intermediate members. Thus, it is possible to easily replace the heads with the head position accuracy being maintained.

Figure 1:
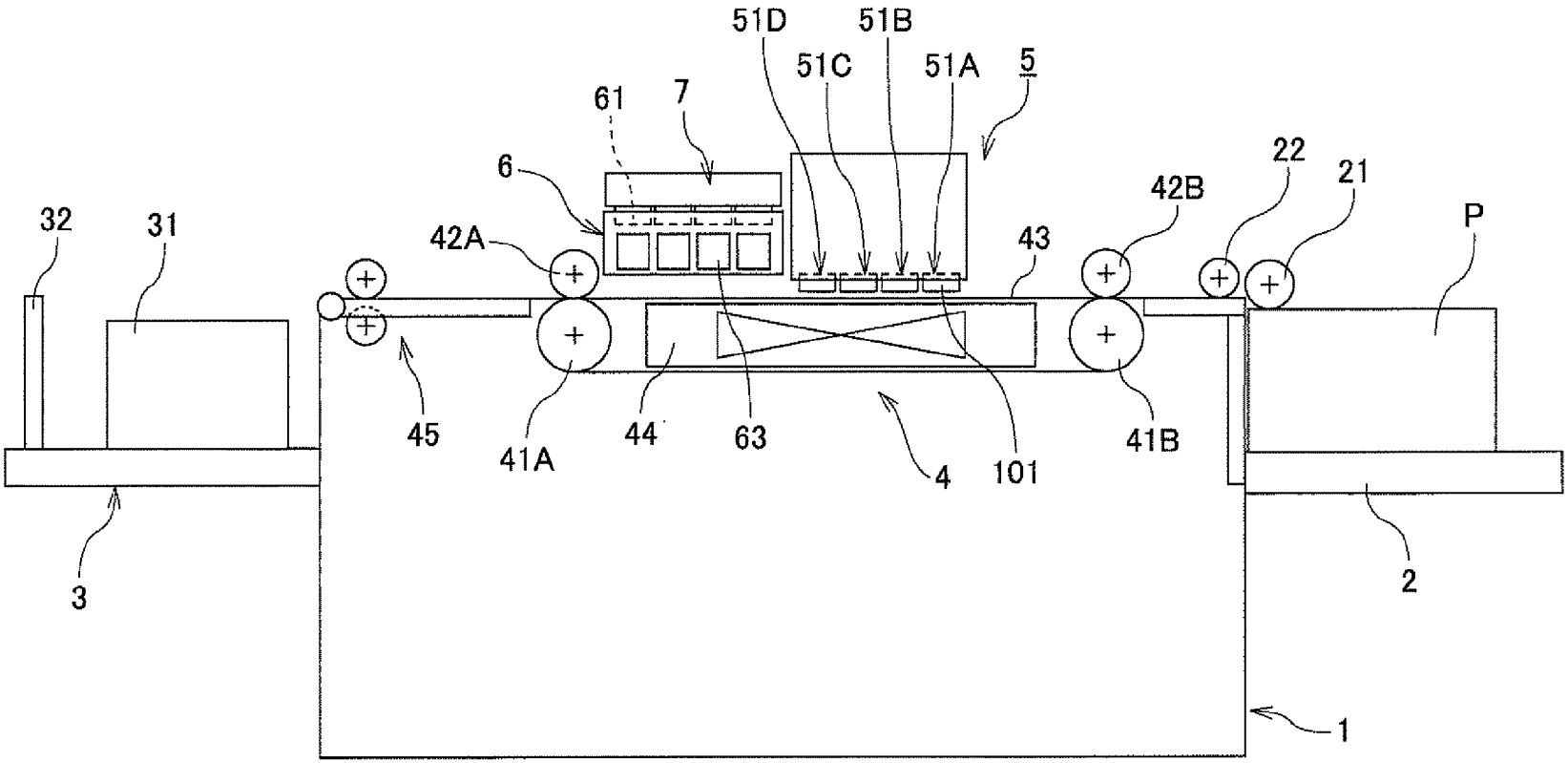
FIG. 1 shows a general configuration of the entirety of one example of an image forming apparatus according to an embodiment of the present invention.
Figure 2:
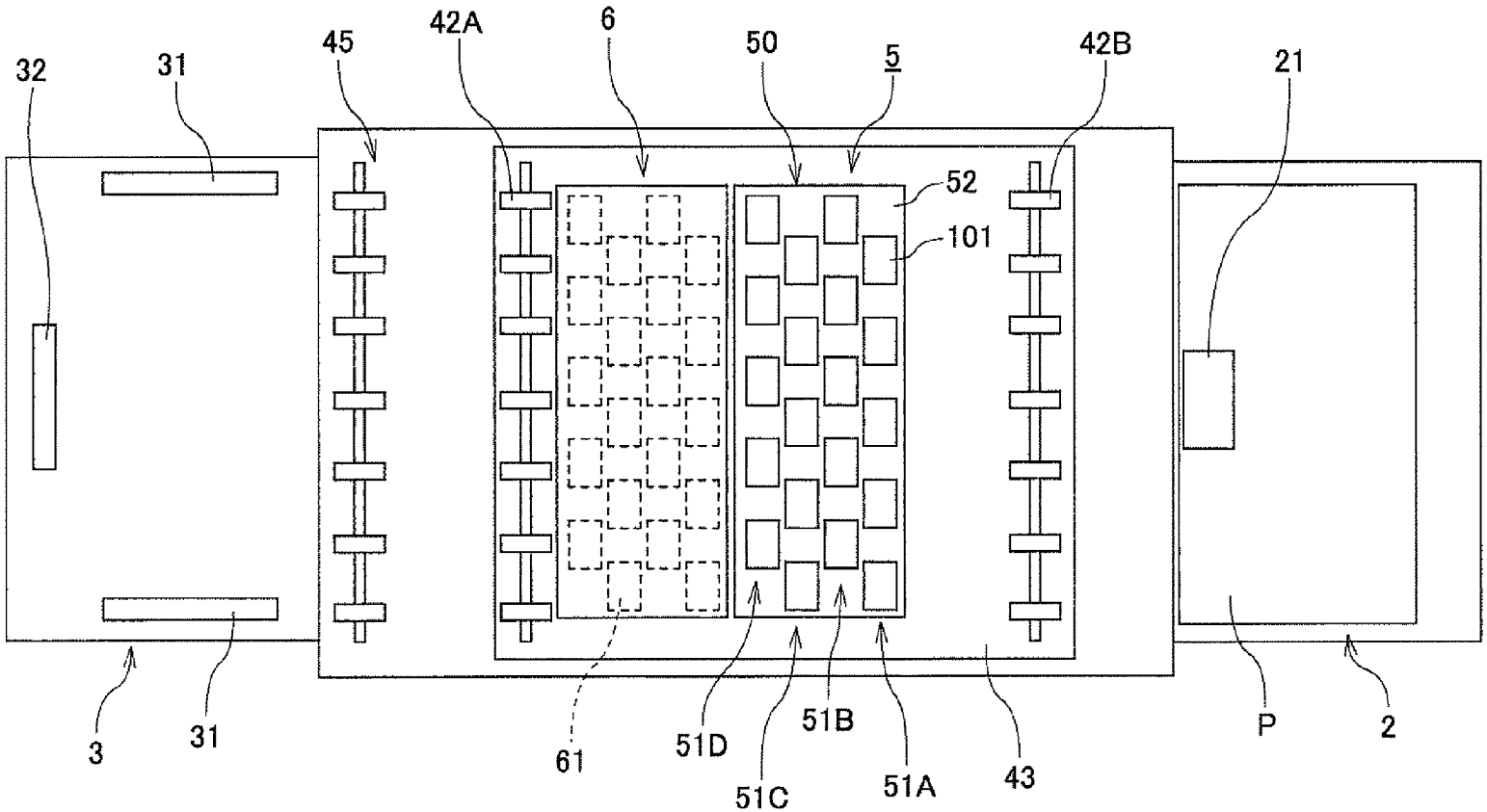
FIG. 2 shows a plan view of the general configuration of the entirety of the example of the image forming apparatus shown in FIG. 1.

With reference to figures, embodiments of the present invention will be described in detail. First, one example of an image forming apparatus according to the present invention will be described with reference to FIGS. 1 and 2. It is noted that FIG. 1 shows an elevation view of a general configuration of the entirety of the image forming apparatus and FIG. 2 diagrammatically shows a plan view of the image forming apparatus.

The image forming apparatus in this example is the line-type image forming apparatus and includes an apparatus body 1; and a paper feeding tray 2 in which sheets of paper P are loaded and which feeds the paper P, sheet by sheet. The image forming apparatus further includes a paper ejecting tray 3 on which sheets of paper P on which printing has been carried out are ejected and loaded; a conveyance part 4 that conveys the paper P from the paper feeding tray 2 to the paper ejecting tray 3; and a head part 5 that includes a recording head (head array unit) 50 which discharges liquid droplets to and prints on the paper P that is being conveyed by the conveyance part 4. The image forming apparatus further includes a head maintenance apparatus (which may be simply referred to as a maintenance apparatus) 6 that is a maintenance and recovery mechanism which carries out a maintenance and recovery operation on respective heads 101 of the head part 5 after printing is finished or at a necessary timing. The image forming apparatus further includes a cleaner apparatus 7 that is a wiper cleaning part which cleans caps 61 and wiper blades (wiper members, not shown) of the head maintenance apparatus 6.

The apparatus body 1 includes front and rear side plates and stays not shown, and the paper P loaded on the paper feeding tray 2 is fed to the conveyance part 4, sheet by sheet, by means of a separating roller 21 and a paper feeding roller 22.

The conveyance part 4 includes a conveyance driving roller 41A, a conveyance driven roller 41B, and a conveyance belt 43 of an endless type which is wound between these rollers 41A and 41B. On a surface of the conveyance belt 43, plural suction holes (not shown) are formed, and a suction fan 44 that suctions the paper P is provided below the conveyance belt 41. Further, above the conveyance driving roller 41A and the conveyance driven roller 41B, conveyance guiding rollers 42A and 42B are respectively held by guides (not shown), and come into contact with the belt 43 by their own weights.

The conveyance belt 43 moves to circulate as a result of the conveyance driving roller 41A being rotated by a motor (not shown), the paper P is suctioned onto the conveyance belt 43 by the suction fan 44, and the paper P is conveyed by the conveyance belt 43 by the circulating movement of the conveyance belt 43. It is noted that the conveyance driven roller 41B and the conveyance guiding rollers 42A and 42B are driven and rotated by the conveyance belt 53.

Above the conveyance unit 4, the head part 5 including plural heads 101 that discharge liquid droplets to print on the paper P is disposed in a movable (in the example, movable in the upward and downward directions) manner. The head part 5 is lifted to a position such that a space into which the maintenance apparatus 6 is inserted below the head part 5 at a time of the maintenance and recovery operation is ensured.

The head part 5 includes the head array unit (which may be referred to as the recording head) 50 having four head rows 51A, 51B, 51C and 51D each including the plural (in this example, five) heads 101 that are arranged to form a line on a base member 52 that is a head supporting member. Each of the heads 101 is configured such that two rows of plural nozzles (not shown) are arranged on a nozzle surface. One row of nozzles of the two rows of nozzles of each head 101 of the head rows 51A and 51B discharge yellow (Y) liquid droplets, and the other row of nozzles of the two rows of nozzles of each head 101 of the head rows 51A and 51B discharge magenta (M) liquid droplets. Further, one row of nozzles of the two rows of nozzles of each head 101 of the head rows 51C and 51D discharge cyan (C) liquid droplets, and the other row of nozzles of each head 101 of the head rows 51C and 51D discharge black (K) liquid droplets. That is, the head part 5 is such that the two head rows 51A and 51B or 51C and 51D which discharge liquid droplets of the same colors are arranged along the paper conveyance direction, and the two head rows 51A and 51B or 51C and 51D include the nozzle rows for respective lines each corresponding to the paper width. It is noted that, in this example, 150 dpi (dots per inch) correspond to one line of an image.

It is noted that the line configuration of each color is not limited to the above-mentioned configuration, and an arrangement of the respective colors is not limited. Also, a configuration of the head part 5 is not limited to the above-mentioned example, and, for example, two head parts each corresponding to the above-mentioned head part 5 may be arranged, one color may be assigned to one head row, and thus, image resolution may be doubled.

Further, in the head part 5, a branch member (not shown) that supplies ink to the corresponding heads 101 of the recording head 50 is disposed for each color, a sub-tank is disposed on an upstream side of the branch member, and a suitable negative pressure is created for maintaining meniscuses of the nozzles of the corresponding heads 101 by means of a head difference between the sub-tank and the corresponding heads 101. Further, on the further upstream side of the sub-tank, a replaceable main tank (not shown) which stores the ink is disposed.

On the downstream side of the conveyance part 4, a conveyance guiding part 45 that conveys the paper P to the paper ejecting tray 3 is disposed. The paper P conveyed by the conveyance guiding part 45 is ejected to the paper ejecting tray 3. The paper ejecting tray 3 includes a pair of side fences 31 that control movements of the paper P in the width directions of the paper P and an end fence 32 that controls a movement of the leading edge of the paper P.

Above the conveyance part 4 on a side of the head part 5, the maintenance apparatus 6 that carries out maintenance of the nozzle surfaces of the heads 101 is disposed. The maintenance apparatus 6 has caps 61 that correspond to the heads 101 of the head rows 51A, 51B, 51C and 51D and cap the nozzle surfaces; wiper members (i.e., wiper blades, not shown) that correspond to the heads 101 and wipe the nozzle surfaces; and a suction part (not shown) that suctions from the insides of the caps 61 of one row. The maintenance apparatus 6 suctions from the nozzles through the caps 61 by means of the suction parts in a condition in which the nozzle surfaces of the heads 101 are sealed by the caps 61. Thus, ink having increased viscosity is ejected from the nozzles, and the discharging performance of the heads 101 is recovered.

It is noted that the suction parts, passages (not shown) connecting the caps 61 and the suction parts, pressure chambers (not shown) and so forth of the maintenance apparatus 6 may be disposed on the outside of the rear side plate of the apparatus body 1, and may be connected by using routes such as tubes. Further, at the time of maintenance and recovery operations, instead of the suction, or together with the suction, the insides of the heads 101 may be pressurized from the upstream sides of the heads 101 by means of pressurizing parts (not shown).

The maintenance apparatus 6 is disposed slidably along the paper conveyance directions above the conveyance part 4, moves to below the head part 5 after the head part 5 is lifted at the time of the maintenance and recovery operation, and retreats to a position shown in FIG. 1 at a time of printing operation.

Above the maintenance apparatus 6, the cleaner apparatus 7 that cleans liquid drops (waste liquid) having adhered to the caps 61 and the wiper blades (not shown) is disposed. The cleaner apparatus 7 is disposed in a manner of movable in vertical (upward and downward) directions with respect to the paper conveyance plane by means of a cleaner moving part (not shown). In a condition in which the maintenance apparatus 6 having finished maintenance of the heads 101 has retreated to the side of the head part 5, the cleaner apparatus 7 moves in the downward direction, and cleans the caps 61 and the wiper blades.

Figure 3A:
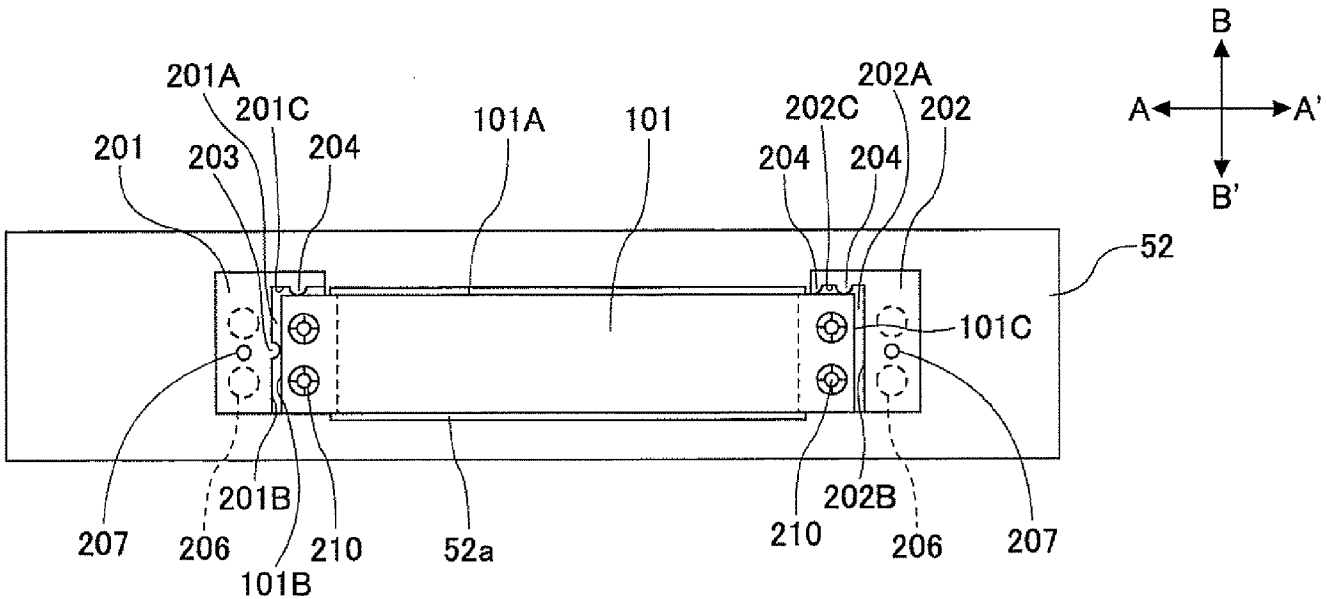
FIG. 3A shows a plan view of a part of a head array unit for one head according to a first embodiment of the present invention.

Next, the head array unit 5 according to a first embodiment of the present invention will be described with reference to FIGS. 3A and 3B. FIG. 3A shows a plan view of a part of the head array unit 5 for one head 101 according to the first embodiment, and FIG. 3B shows a front sectional elevation view of the part of the head array unit 5 for one head 101 according to the first embodiment.

Figure 3B:
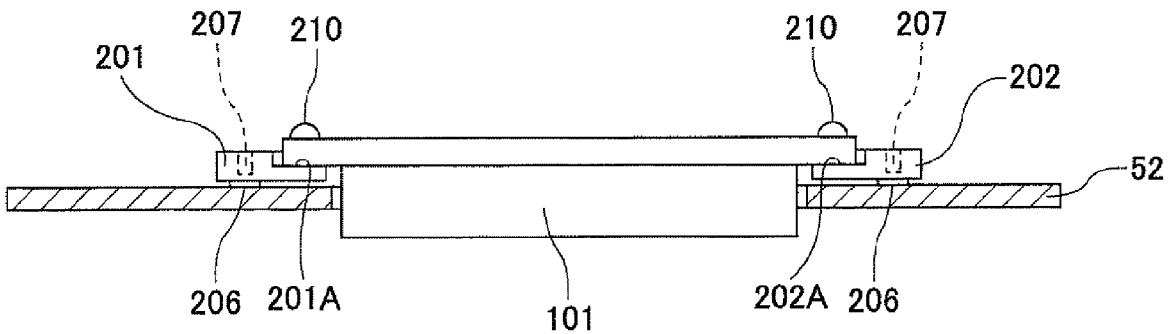
FIG. 3B shows a front sectional view of the part of the head array unit for one head according to the first embodiment of the present invention.

As shown in FIGS. 3A and 3B, in the head array unit 50, for each head 101, intermediate members 201 and 202 are fixed to the base member 52 that is a head supporting member, through bonding by using an adhesive or such, and the head 101 is detachably mounted by means of fastening member 210 such as screws to the intermediate members 201 and 202 from a side opposite to a side on which the intermediate members 201 and 202 are fixed to the base member 52. It is noted that an opening part 52*a* is formed in the base member 52 for the head 101.

In the intermediate member 201 is provided a positioning reference part 203 to be used as a reference position for positioning the head 101 in nozzle arrangement directions (indicated by arrows A, A' in FIG. 3A); and a positioning reference part 204 to be used as a reference position for positioning in directions (head row arrangement directions, indicated by arrows B, B' in FIG. 3A) perpendicular to the nozzle arrangement directions. Further, in the intermediate member 202 are provided two positioning reference parts 204 to be used as reference positions for positioning the head 101 in the directions (head row arrangement directions, indicated by arrows B, B' in FIG. 3A) perpendicular to the nozzle arrangement directions.

The positioning reference parts 203 and 204 will now be described in detail. The intermediate member 201 has a depression 201A as shown in FIGS. 3A and 3B, and the depression 201A is defined by side walls 201B and 201C in the directions A and B, respectively, as shown in FIG. 3A. The intermediate member 202 has a depression 202A as shown in FIGS. 3A and 3B, and the depression 202A is defined by side walls 202B and 202C in the directions A' and B, respectively, as shown in FIG. 3A. In the intermediate member 201, the positioning reference part 203 protrudes from the side wall 201B in the direction A'; and the positioning reference part 204 protrudes from the side wall 201C in the direction B', as shown in FIG. 3A. In the intermediate member 202, the two positioning reference parts 204 protrude from the side wall 202C in the direction B', as shown in FIG. 3A. For positioning the head 101 with respect to the intermediate members 201 and 202, the extending end of the head 101 in the direction A is inserted into the depression 201A of the intermediate member 201, and simultaneously, the extending end of the head 101 in the direction A' is inserted into the depression 202A of the intermediate member 202, as shown in FIGS. 3A and 3B. At this time, an end surface 101B of the extending end of the head 101 in the direction A is caused to come into contact with the positioning reference part 203 protruding from the side wall 201B of the intermediate member 201 so that the head 101 is positioned in the directions A, A'. At the same time, a side surface 101A of the head 101 in the direction B is caused to come into contact with the positioning reference part 204 protruding from the side wall 201C of the intermediate member 201 near the end surface 101B of the head 101 in the direction A, and also, with the two positioning reference parts 204 protruding from the side wall 202C of the intermediate member 202 near an end surface 101C of the head 101 in the direction A', so that the head 101 is positioned in the directions B, B'.

The intermediate members 201 and 202 are formed of light transmission resin material such as acrylic resin or polycarbonate, and areas such as bonding areas 206 of the intermediate members 201 and 202 are bonded to the base member 52 by means of, for example, an ultraviolet curing adhesive. Further, position adjustment holes 207 are provided in the intermediate members 201 and 202.

Figure 4A:
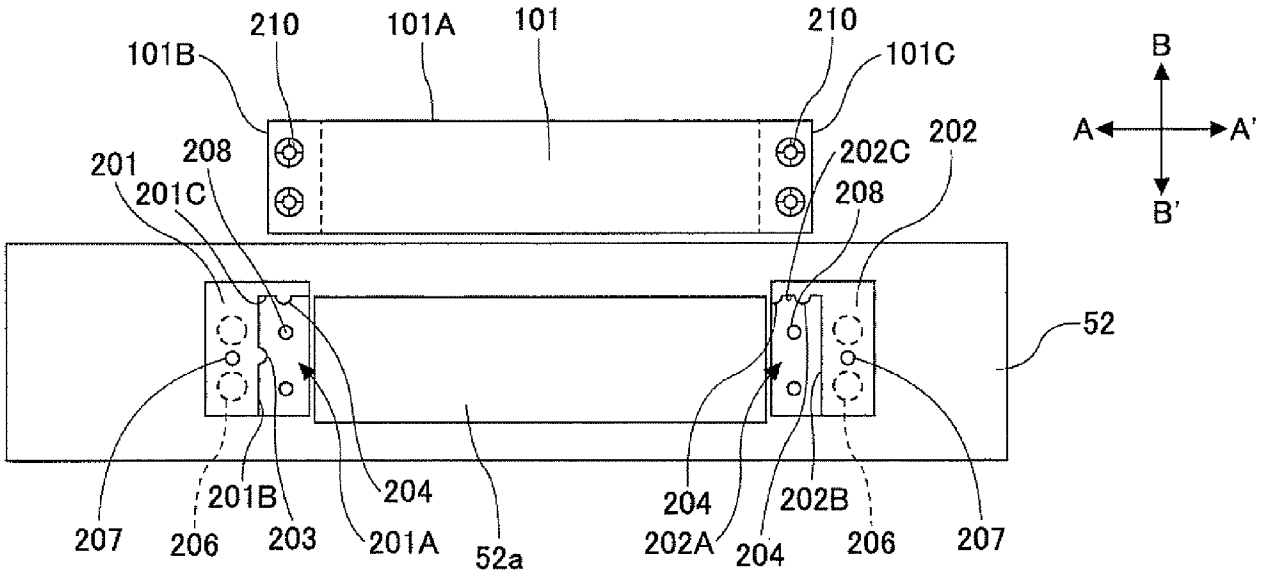
FIGS. 4A and 4B illustrate replacement of the head, and show the part the head array unit for one head, according to the first embodiment of the present invention.
Figure 4B:
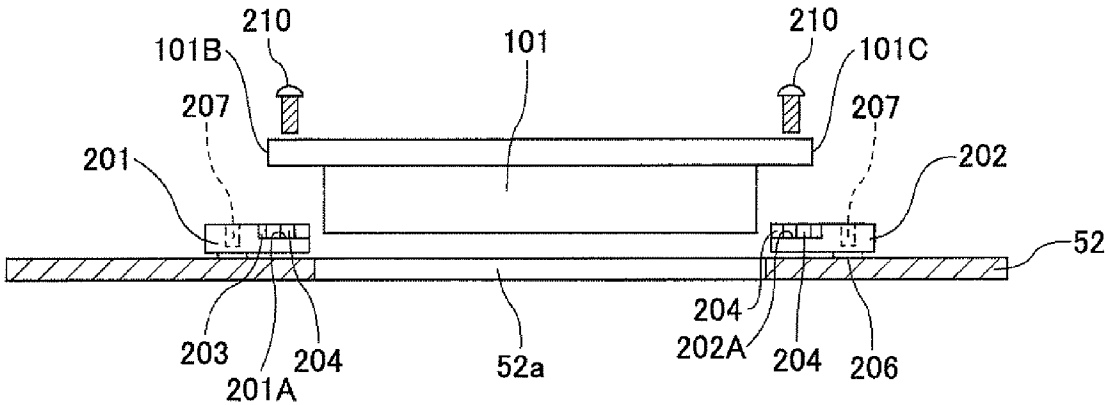

Next, with reference to FIGS. 4A and 4B and FIG. 10B, replacement of the head 101 of the head array unit 50 described above with reference to FIGS. 3A and 3B will be described.

Figure 10A:
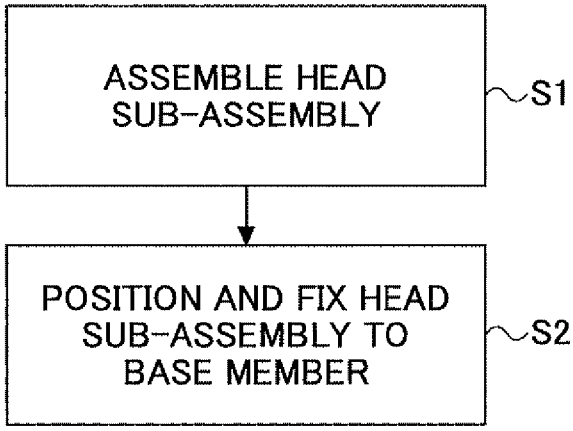
FIG. 10A shows a flowchart illustrating a method of manufacturing the head array unit.
Figure 10B:
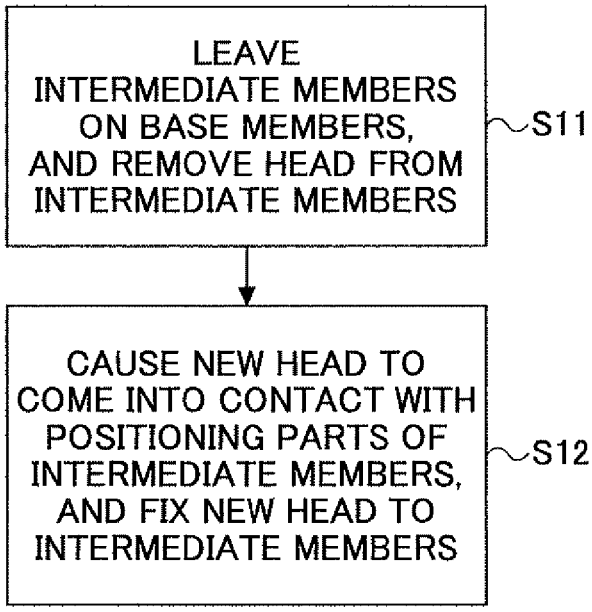
FIG. 10B shows a flowchart illustrating the head replacement method.

When the head 101 is to be replaced, the fastening members 210 are removed and the head 101 is removed from the intermediate members 201 and 202 while the intermediate members 201 and 202 are left on the base member 52 (step S11 of FIG. 10B). After that, in step S12 of FIG. 10B, a new head 101 is fixed to the intermediate members 201 and 202 in a condition where, as described above, the extending ends of the new head 101 in the directions A and A' are inserted into the depression 201A and 202A of the intermediate members 201 and 202, respectively, the end surface 101B of the extending end in the direction A and the side surface 101A in the direction B of the new head 101 are made to come into contact with the positioning reference part 203 protruding from the side wall 201B of the intermediate member 201, the positioning reference parts 204 protruding from the side wall 201C of the intermediate member 201 and the positioning reference parts 204 protruding from the side wall 202C of the intermediate member 202, respectively, as shown in FIG. 3A. Then, in this condition, the head 101 is fixed to the intermediate members 201 and 202 by means of the fastening members 210. Thereby, it is possible to ensure the accuracy of position of the new head 101. It is noted that screw holes 208 are provided in the intermediate members 201 and 202, respectively, to be used for screwing the fastening members 210.

Thus, the intermediate members 201 and 202 having the positioning reference parts 203 and 204 for positioning the head 101 are fixed to the head supporting member (base member 52), and the head 101 is detachably mounted on the intermediate members 201 and 202 from the side of the intermediate members 201 and 202 opposite to the side on which the intermediate members 201 and 202 are fixed to the head supporting member. Thereby, it is possible to easily replace the head 101 with the accuracy of position of the head 101 being maintained.

Figure 5A:
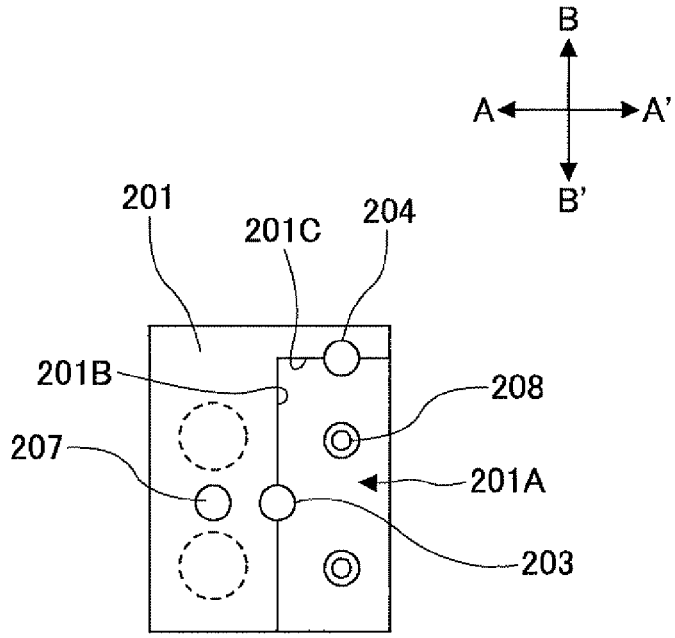
FIG. 5A shows a plan view of an intermediate member in a head array unit according to a second embodiment of the present invention.
Figure 5B:
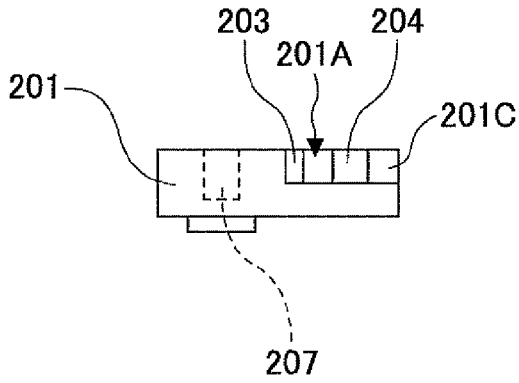
FIG. 5B shows a front sectional view of the intermediate member in the head array unit according to the second embodiment of the present invention.

Next, a recording head (head array unit) 50 according to a second embodiment of the present invention will be described with reference to FIGS. 5A and 5B. FIG. 5A shows a plan view of the intermediate member 201 in the recording head 50 according to the second embodiment and FIG. 5B shows a front elevation view of the intermediate member 201 in the recording head 50 according to the second embodiment.

The recording head 50 according to the second embodiment is the same as the recording head 50 according to the first embodiment described above with reference to FIGS. 3A, 3B, 4A and 4B, except that the positioning reference parts 203 and 204 of the intermediate member 201 and the intermediate member 202 (not shown in FIGS. 5A and 5B) are made of metal, and the other parts of the intermediate members 201 and 202 are made of transparent resin material that can transmit UV (ultraviolet) light.

According to the second embodiment described above with reference to FIGS. 5A and 5B, although the intermediate members 201 and 202 are made of the transparent resin material that has low hardness, the positioning reference parts 203 and 204 of the intermediate members 201 and 202 are made of metal. Thereby, it is possible to avoid the positioning reference parts 203 and 204 from being worn down at a time of replacing the head 101, and thus, it is possible to maintain high accuracy of position of the head 101 for a long term.

It is noted that the head array unit (recording head) 50 according to the first embodiment or the second embodiment described above with reference to FIGS. 3A, 3B, 4A, 4B, 5A and 5B may be applied to the image forming apparatus according to the embodiment described above with reference to FIGS. 1 and 2 as each of the head array units (recording heads) 50 included in the head part 5.

Next, with reference to FIGS. 6A, 6B, 7A, 7B, 8A, 8B, 9A and 9B and FIG. 10A, a method of manufacturing the head array unit (recording head) 50 according to the first embodiment or the second embodiment described above with reference to FIGS. 3A, 3B, 4A, 4B, 5A and 5B will be described.

Figure 6A:
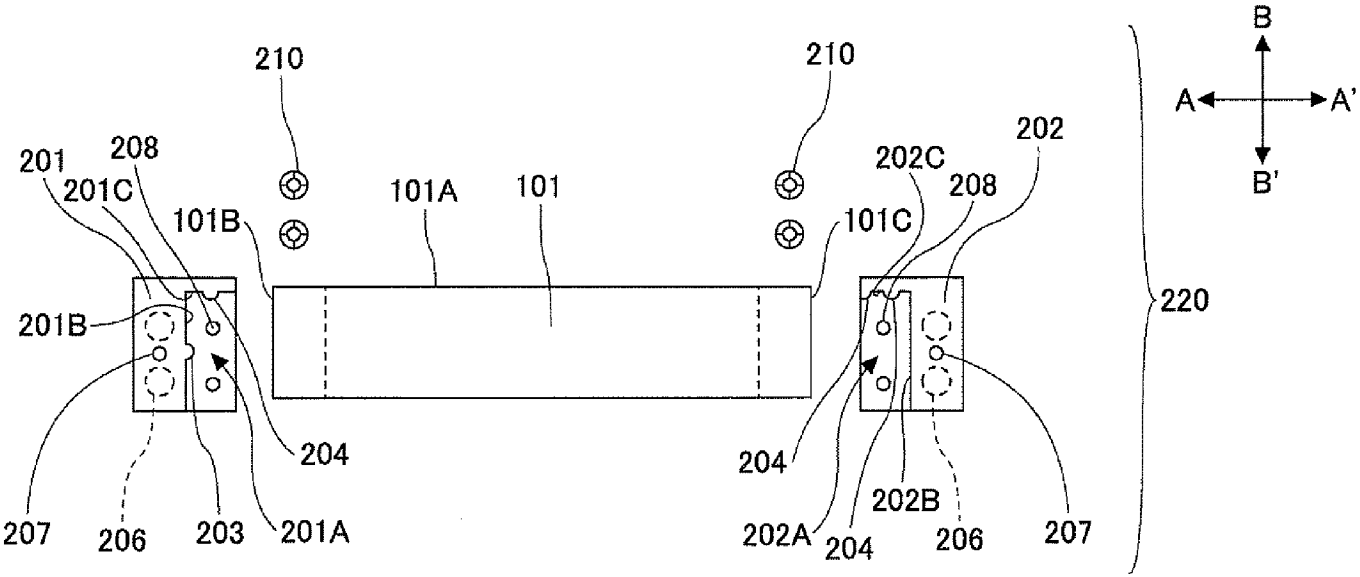
FIGS. 6A and 6B show a state before a head sub-assembly is assembled, for the part of the head array unit for one head.
Figure 6B:
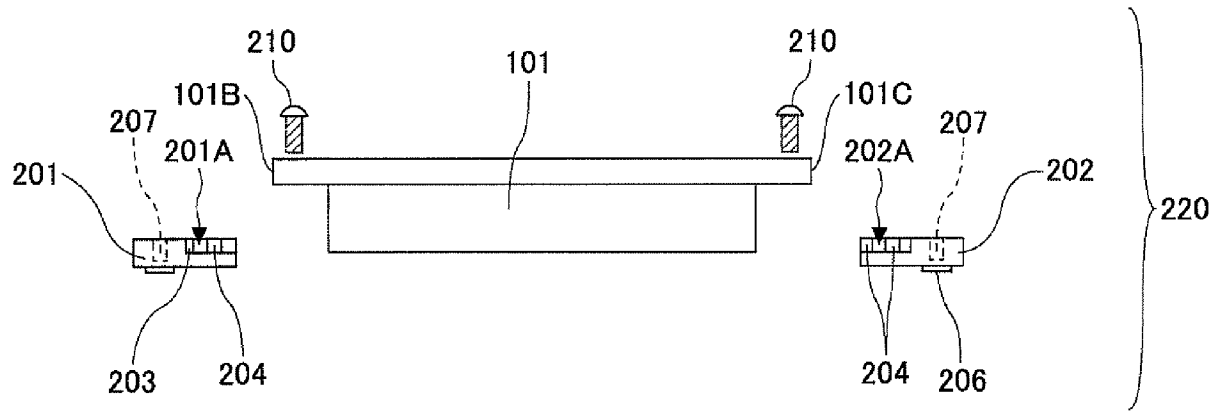
Figure 7A:
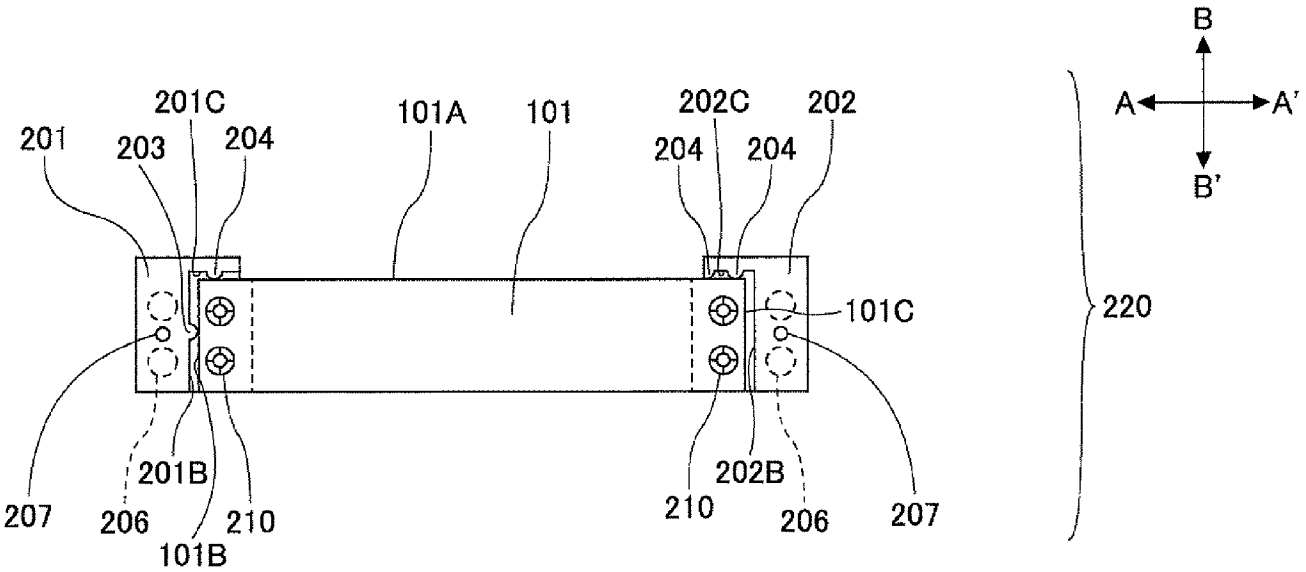
FIGS. 7A and 7B show a state after the head sub-assembly is assembled, for the part of the head array unit for one head.
Figure 7B:
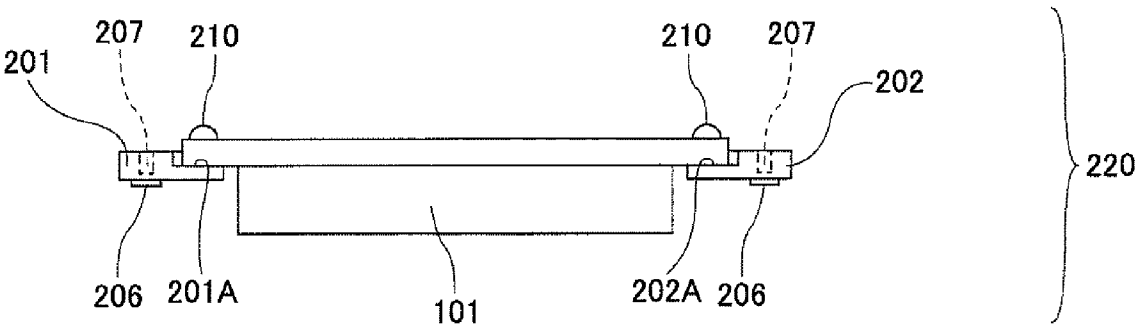

A head sub-assembly 220, included in the head array unit 50, for each head 101, includes the head 101, the intermediate members 201 and 202, and the fastening members 210, as shown in FIGS. 6A and 6B. As shown in FIGS. 7A and 7B, the head 101 is fixed to the intermediate members 201 and 202 by means of the fastening members 210 in a condition where, as mentioned above, the head 101 is made to come into contact with the positioning reference parts 203 and 204 of the intermediate members 201 and 202. Thus, the head sub-assembly 220 is assembled (step S1 of FIG. 10A).

Figure 8A:
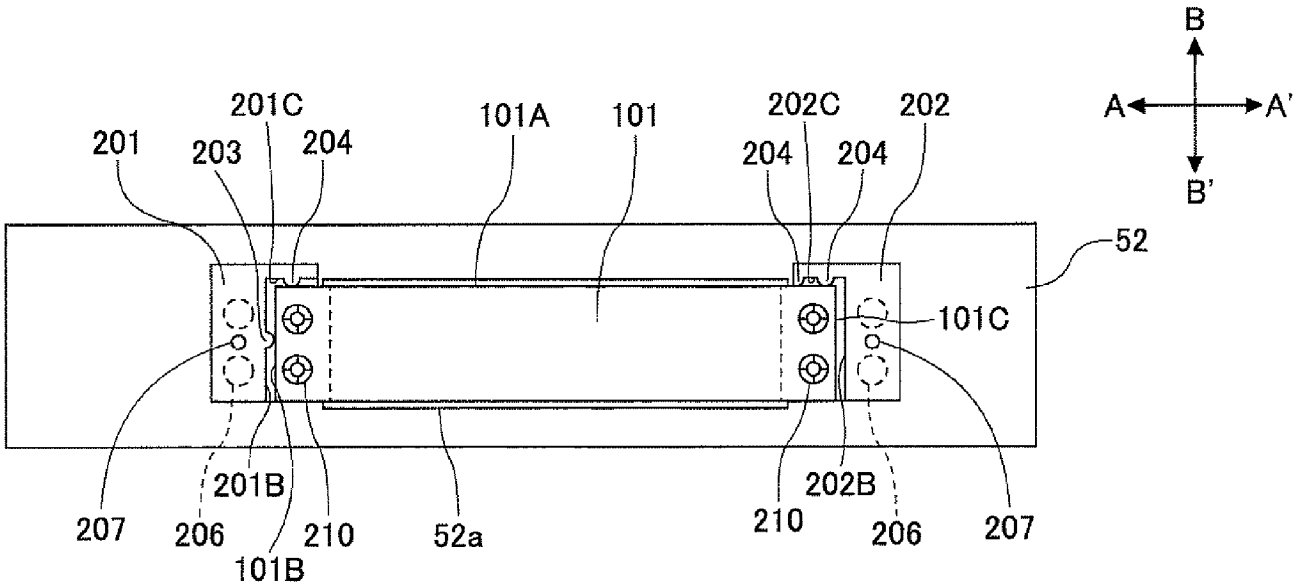
FIGS. 8A and 8B show a state in which the head sub-assembly is fixed to a base member and the head array unit is assembled, for the head array unit for one head.
Figure 8B:
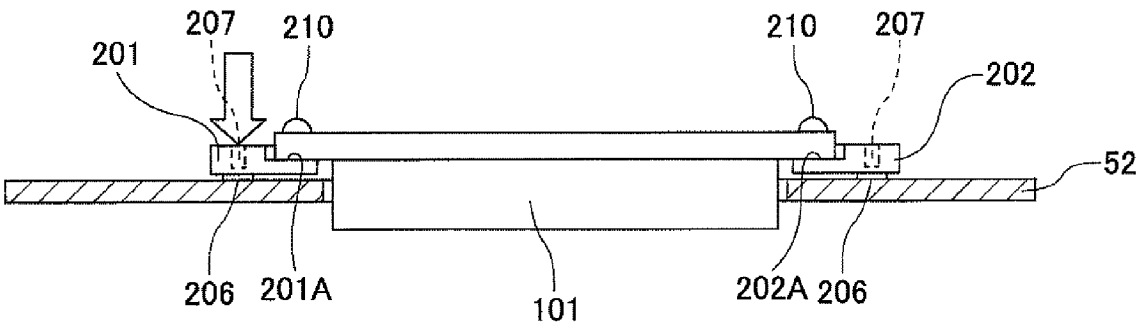

Then, in step S2 of FIG. 10A, as shown in FIGS. 8A and 8B, the head sub-assembly 220 is positioned through optical adjustment with respect to the base member 52 in such a manner that an alignment mark (not shown) provided on the head 101 becomes at predetermined position of the base member 52, and the intermediate members 201 and 202 are bonded and fixed to the base member 52 by using an ultraviolet curing adhesive or such.

By thus fixing the head sub-assembly 220 to the base member 52, it is not necessary to form positioning parts on the base member 52 by means of molding or machining, and the base member merely needs to have the opening parts 52*a* through which the liquid droplet discharging surfaces of the heads 101 protrude, respectively. Thus, it is possible to reduce the costs required for materials and machining. That is, at the time of manufacturing, positioning between the base member 52 and the heads 101 is carried out in a condition in which the intermediate members 201 and 202 have been fixed to the heads 101 respectively and the head sub-assemblies 220 have been thus assembled as described above with reference to FIGS. 6A, 6B, 7A and 7B. Then, the intermediate members 201 and 202 are bonded to the base member 52. Therefore, when the head 101 is replaced afterwards, the intermediate members 201 and 202 are used as reference positions for positioning a new head 101.

Figure 9A:
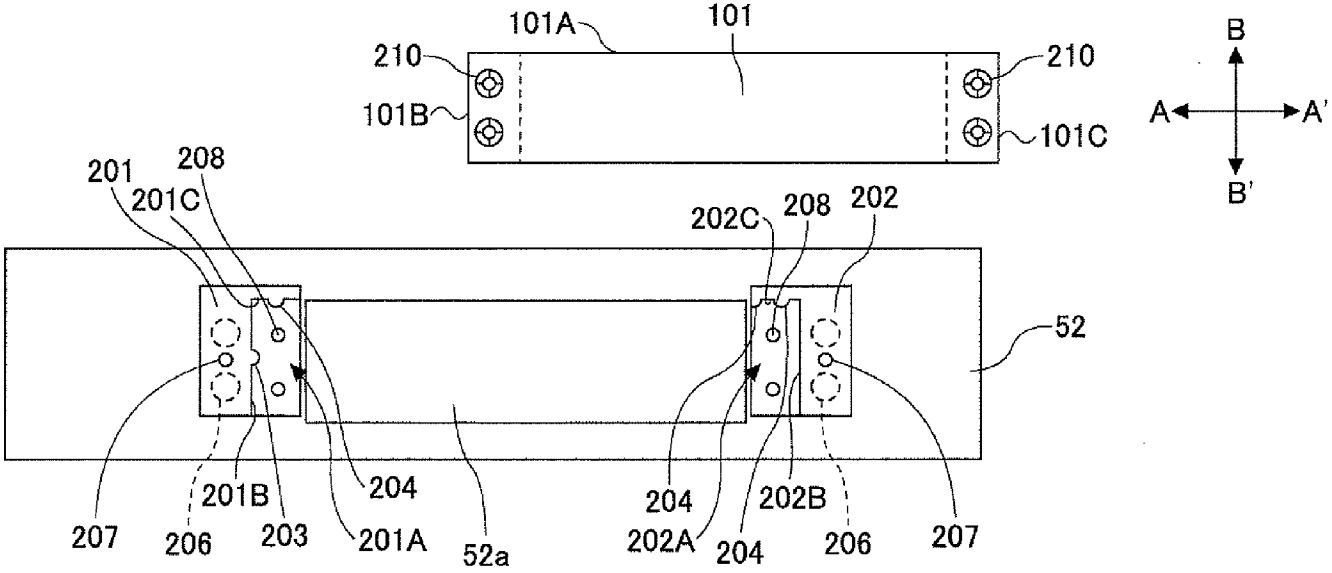
FIGS. 9A and 9B illustrate a procedure in which a head is removed from the head array unit and a new head is mounted on the head array unit, for the part of the head array unit for one head.
Figure 9B:
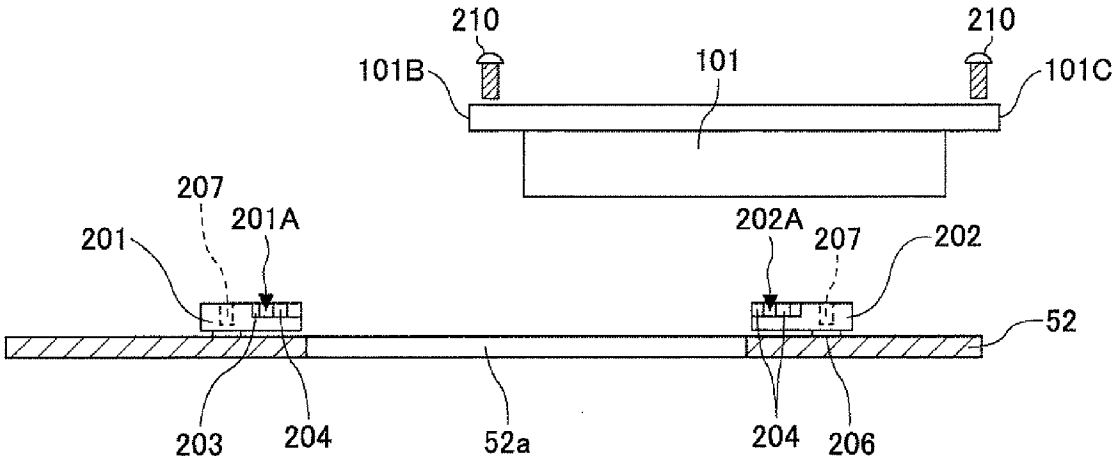

That is, as mentioned above, the head 101 has been thus detachably mounted on the intermediate members 201 and 202 from the side of the intermediate members 201 and 202 opposite to the side on which the intermediate members 201 and 202 are bonded to the base member 52. Therefore, when the head 101 is to be replaced in the head array unit 50, as shown in FIGS. 9A and 9B, the intermediate members 201 and 202 are left on the base member 52, and in this condition, the fastening members 210 are removed and the head 101 is removed from the intermediate members 201 and 202. Then, a new head 101 is fixed to the intermediate members 201 and 202 by means of the fastening members 210 in a condition in which the new head 201 is made to come into contact with the positioning reference parts 203 and 204 of the intermediate members 201 and 202. Thereby, it is possible to replace the head 101 with the accuracy of positioning the head 101 being ensured.

Thus, by using the configuration of the head array unit 50 according to any one of the embodiments of the present invention, it is possible to achieve the head array unit for which it is possible to reduce the manufacturing costs, and simultaneously, it is possible that the user can easily replace the head 101.

It is noted that in the above-described embodiments, the plural heads 101 corresponding to each head row are supported by the head supporting member (base member 52), as an example. As another example, it is also possible to apply the present invention in the same way to a head array unit in which the head array unit corresponds to each head row, and each head array unit is fixed to a common supporting member (arrangement member).

The present invention is not limited to the specifically disclosed embodiments, and variations and modifications may be made without departing from the scope of the present invention.

The present application is based on Japanese Priority Application No. 2010-049820, filed on Mar. 5, 2010, the entire contents of which are hereby incorporated herein by reference.

What is claimed is:

1. A head array unit comprising:

plural heads that discharge liquid droplets;

a head supporting member in which the plural heads are positioned and fixed; and intermediate members, fixed to the head supporting member, having positioning reference parts configured to position the heads, wherein the heads are mounted on the intermediate members detachably from an opposite side of the intermediate members with respect to the head supporting member.

2. The head array unit as claimed in claim 1, wherein the intermediate members are made of light transmission resin material.

3. The head array unit as claimed in claim 1, wherein the heads are fixed to the intermediate members by means of screw members.

4. The head array unit as claimed in claim 1, wherein the positioning reference parts of the intermediate members are made of materials different from materials of other parts of the intermediate members.

5. An image forming apparatus comprising the head array unit claimed in claim 1.

6. A method of replacing the heads of the head array unit claimed in claim 1 with other heads, in which head array unit in a condition in which the heads are fixed to the intermediate members, the heads are positioned at predetermined positions and the intermediate members are fixed to the head supporting member, the method comprising:

leaving the intermediate members on the head supporting member and removing the heads from the intermediate members; and fixing the other heads to the intermediate members.

* * * * *